US007635159B2

(12) United States Patent
Chen et al.

(10) Patent No.: US 7,635,159 B2
(45) Date of Patent: Dec. 22, 2009

(54) COLLAPSING DEVICE AND CHILD SEAT USING THE SAME

(75) Inventors: Shun-Min Chen, Taipei (TW); Hong-bin Xu, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 70 days.

(21) Appl. No.: 12/010,013

(22) Filed: Jan. 18, 2008

(65) Prior Publication Data

US 2008/0185878 A1 Aug. 7, 2008

(30) Foreign Application Priority Data

Feb. 6, 2007 (CN) ..... 2007 2 0004714 U

(51) Int. Cl.
*A47C 4/00* (2006.01)

(52) U.S. Cl. ..... 297/16.1

(58) Field of Classification Search ..... 297/16.2, 297/16.1, 463.1, 183.2, 183.3, 149, 151; 280/47.38, 650, 647
See application file for complete search history.

(56) References Cited

U.S. PATENT DOCUMENTS 6,715,828 B1 * 4/2004 Cheng ..... 297/183.3
7,334,836 B2 * 2/2008 Chen ..... 297/16.1
7,441,835 B2 * 10/2008 Chen et al. ..... 297/16.1

* cited by examiner

*Primary Examiner*—Milton Nelson, Jr.
(74) *Attorney, Agent, or Firm*—Bacon & Thomas, PLLC

(57) ABSTRACT

A collapsing device for child seat is provided. The collapsing device comprises a operating mechanism mounted on a connecting tube of the child seat, a safety button for preventing an accidental actuation of the operating mechanism, two engaging units disposed in the connecting tube of the child seat, and two cables connecting the two engaging units to the operating mechanism respectively for transmitting the operation of the operating mechanism to the engaging unites so as to perform a collapsing operation of the child seat.

20 Claims, 7 Drawing Sheets

COLLAPSING DEVICE AND CHILD SEAT USING THE SAME

FIELD OF THE INVENTION

The present invention relates generally to a single-hand-operated collapsing device, and more specifically to a collapsing device that can be operated by a single hand to allow the front legs and rear legs of a child seat to collapse pivotally.

BACKGROUND OF THE INVENTION

Child seats for children are well known children's appliances and are already commercially available. In order to facilitate storing, most of the child seats for children are usually designed in a collapsible form. For instance, U.S. Pat. No. 6,854,800 has disclosed a collapsible child seat. As illustrated in FIG. 4 of the U.S. Pat. No. 6,854,800 patent, the child seat can be collapsed from a extended state (as illustrated in FIG. 1) to a collapsed stated (as illustrated in FIG. 2) by operating the operation handle 26 to pull transmission cables 27 to disengage the pins 29 from the engagement holes 31. Although the collapsing device of the U.S. Pat. No. 6,854,800 patent, i.e., including the handle 26, the cables 27, the pins 29, and the engagement holes 31 etc., can achieve the function of collapsing the child seat, however, it takes two hands to properly operate/collapse the child seat and this causes inconvenience in use. Therefore, there exists a need for a collapsing device of a child seat which allows the user to effectively perform the collapsing operation of the child seat with one hand in a one-step operation.

SUMMARY OF THE INVENTION

Accordingly, one object of the present invention is to provide a collapsing device of a child seat which can be easily operated by only one hand of the user.

To achieve this and other objects, a collapsing device for a child seat according to a first embodiment of the present invention is provided, the child seat having a stand which includes a connecting tube which has two arm portions connecting to the stand, the collapsing device of a child seat comprising: an operating device which is mounted to the connecting tube and has an operation button and an actuating unit coupled to the operation button, the actuating unit being operable by the operation button to move between a first position to a second position; at least one engaging element operably disposed in the arm portion of the connecting tube and including a locking member, the locking member being movable between a locked state that the locking member engages with the stand and the connecting tube and an unlocked state that the locking member disengages with the stand; and at least one transmission member whose two ends are connected to the actuating unit of the operating device and the at least one engaging element respectively, whereby the locking member is moved from the locked state to the unlocked state by the operation button through the at least one transmission member, so that the child seat can be collapsed from an extended state to a collapsed state.

According to this embodiment, the locking member comprises two pivotally coupled arm members and a clip spring disposed between the arm members, wherein the two arms and the clip spring are arranged such that while one end of the two arms close to each other, and the other end is apart from each other, a protrusion projecting laterally formed at the other end.

According to this embodiment, the at least one engaging element further comprises an actuating member connected to the at least one transmission member to actuate the locking member from the locked state to the unlocked state, wherein at the ends of the two arms that are close to each other, slanted surfaces are respectively formed at the ends of the arms facing each other, and guiding surfaces are formed on the actuating members at positions corresponding to the slanted surfaces.

According to this embodiment, the collapsing device further comprises a safety member which is pivotally coupled to the operation button and is arranged selectively to prevent the operation button from being operated.

According to a second embodiment of the present invention, a collapsing device of a child seat is provided, the child seat has a stand which includes a connecting tube and legs wherein the connecting tube has two arm portions connecting to the legs, the collapsing device of a child seat comprises:

an operating device which includes a housing mounted to the connecting tube, an operation button which is operably connected to and partially accommodated in the housing and is arranged such that it is capable of moving relative to the housing between a position away from the connecting tube and a position close to the connecting tube, and a pair of actuating arms, one end of the actuating arms being pivotally coupled to the operation button and the other end having an arcuate contour and being disposed adjacent to the connecting tube, such that the operation button is moved between the position away from the connecting tube where the other ends of the actuating arms are resiliently pivoted close to each other and the position close to the connecting tube where the other ends of the actuating arms are apart from each other;

two engaging elements each operably disposed in the arm portion of the connecting tube and including an locking member for retaining the engaging element in position, the locking member being movable between a locked state that the locking member engages with the stand and the connecting tube and an unlocked state that the locking member disengages with the stand and the connecting tube; and two transmission members whose two ends are connected to the actuating unit of the operating device and one of the two engaging elements respectively, wherein the locking member is moved from the locked state to the unlocked state by the operation button through the at least one transmission member, so that the child seat can be collapsed from an extended state to a collapsed state.

According to this embodiment, the two actuating arms are arranged in a form of substantially V-shaped arrangement, and a torsion spring is disposed at a joint of the V-shaped arranged actuating arms and has two limbs disposed in the actuating arms respectively, so as to allow the actuating arms to pivot resiliently with each other.

Additionally, a collapsible child seat convertible between an extended state and a collapsed state is provided, the collapsible child seat comprising: a stand having two front legs, two rear legs pivotal connected to front legs respectively, and a connecting tube, the connecting tube includes a pair of arm portions, one ends of the arm portions are pivotally coupled to the front legs, the other ends of the arm portions are slidable coupled to a mounting seat of each rear leg, a collapsing device mounted on the connecting tube and having a pair of engaging devices disposed in the pair of arm portions respectively; wherein the collapsing device is mounted between a locked state where the engaging devices are engaged with the mounting seats of the rear legs respectively, and an unlocked state where the engaging devices are disengaged from the mounting seat of the rear legs and the arm portions of the connecting tube is capable of sliding relative to the mounting seats and pivoting relative to the front legs and the rear legs to help the child seat moving from the extended state to the collapsed state.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now being made to the following description taken in conjunction with the accompanying drawings, wherein.

DETAILED DESCRIPTION OF THE INVENTION

Figure 1A:
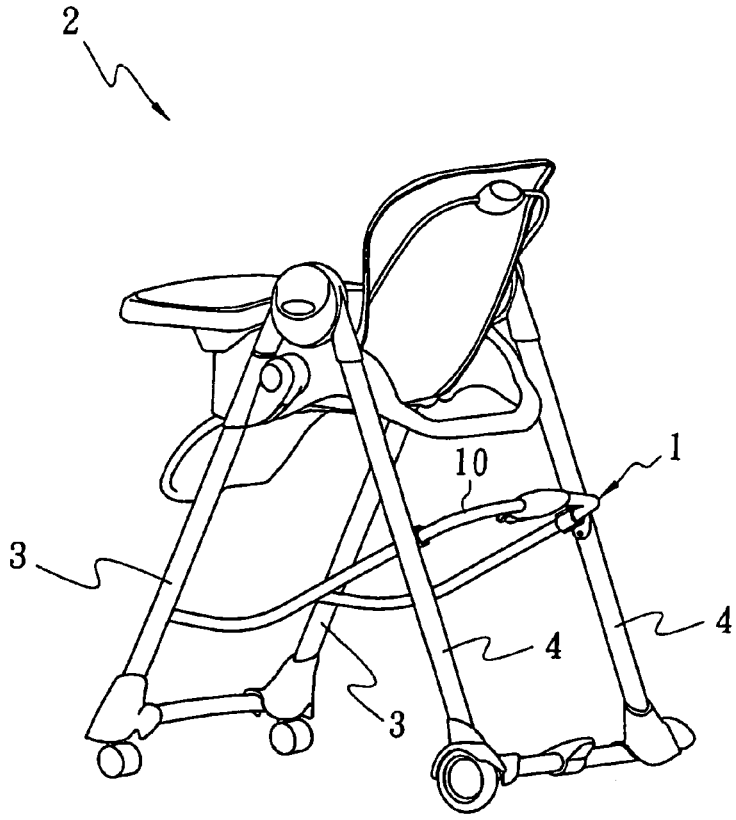
FIGS. 1A and 1B are perspective views illustrating a collapsible child seat incorporating with a collapsing device according to one embodiment of the present invention in an extended state and a collapsed state respectively.

Referring now to the drawings in which preferred embodiments of the present invention are illustrated to describe the present invention.

Figure 1B:
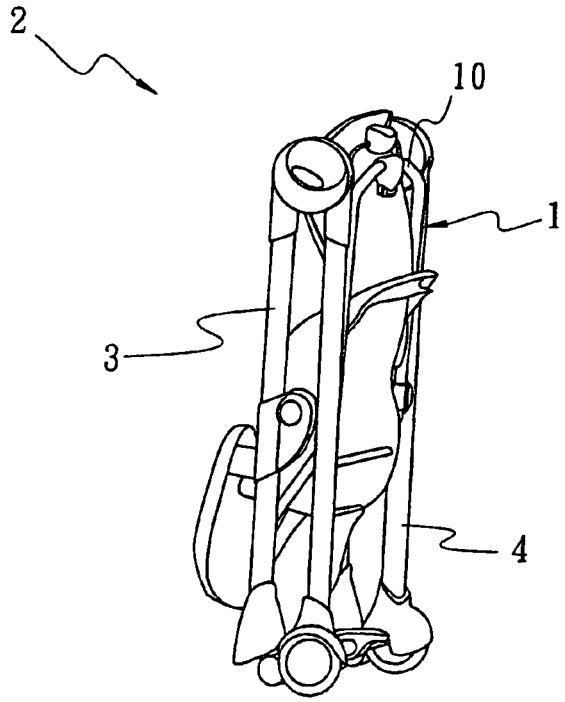
Figure 2:
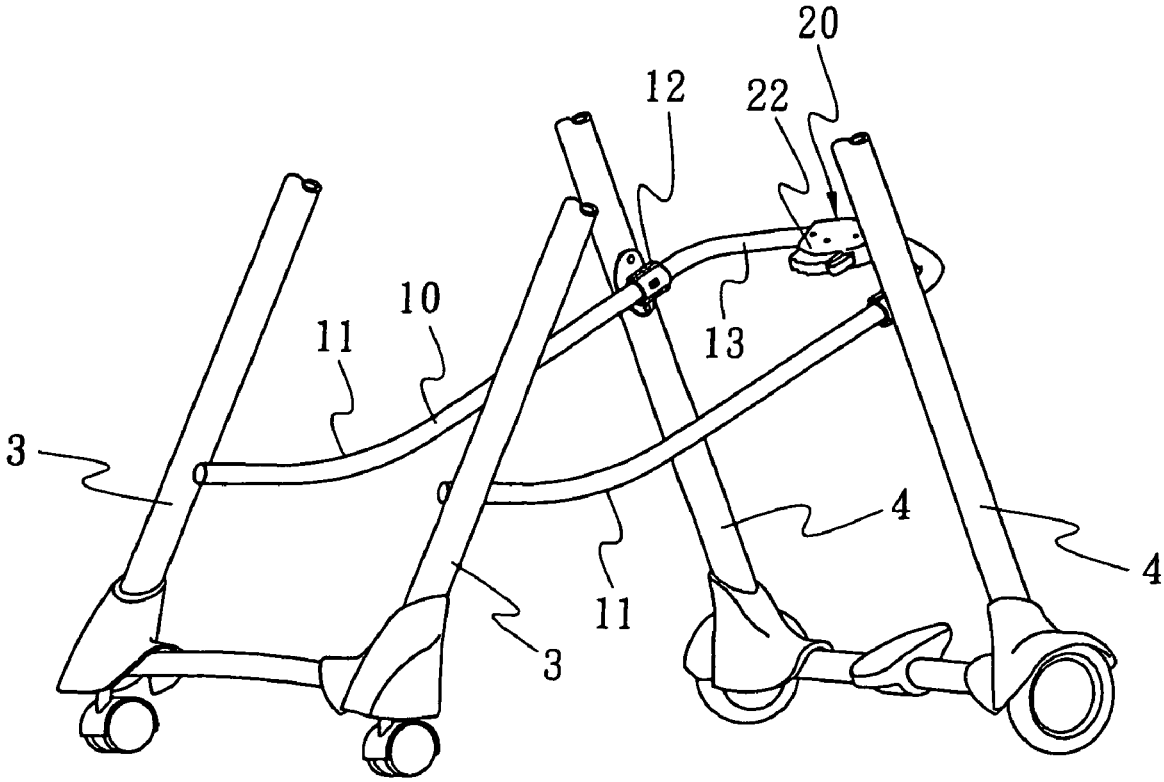
FIG. 2 is an overall perspective view of the collapsing device of the present invention.
Figure 8:
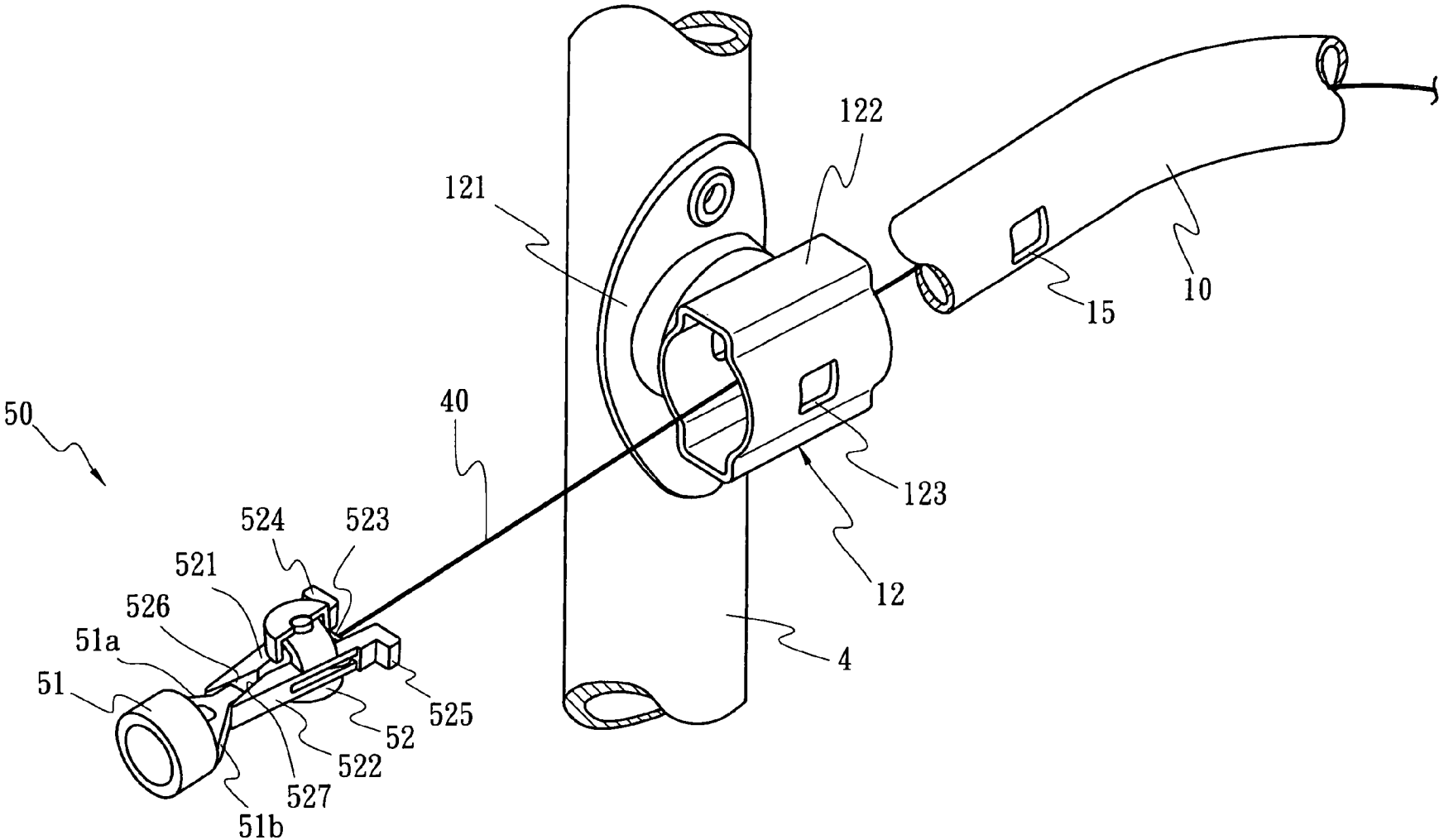
FIG. 8 is a perspective of the engaging element of the collapsing device of the present invention.

FIGS. 1A and 1B are perspective views illustrating a collapsible child seat 2 incorporating with a collapsing device 1 according to one embodiment of the present invention in an extended state and a collapsed state respectively. As shown in the figures, the child seat 2 includes a supporting stand that is constituted by two front legs 3, two rear legs 4 and a connecting tube 10. FIG. 2 is an overall perspective view of the collapsing device 1 of the present invention. As illustrated in FIG. 2, the connecting tube 10 is a substantially U-shaped hollow tube member and has two arm portions 11, and a transverse portion 13 connecting one end of the arm portions 11. The connecting tube 10 is rotatably coupled to the front legs 3 of the child seat 2 at a free end of the arm portions 11 by a fastening member, such as a rivet. Additionally, the arm portions 11 of the connecting tube 10 each has two radially-aligned through holes (labeled as 15 and 16 in FIG. 3) formed in the tube wall at a position close to the joint with the transverse portion 13 and is rotatably coupled to a corresponding rear leg 4 of the child seat 2 through a mounting seat 12. The mounting seat 12, as illustrated in FIG. 8, mainly-includes a mounting portion 121 for mounting to the rear leg 4 of the child seat 2 and a substantially hollow cylindrical shaped supporting portion 122 pivotally coupled to the mounting portion 121 for slidably supporting the arm portion 11 of the connecting tube 10. Additionally, two engaging holes 123 (only one is shown) are formed in the wall of the cylindrical supporting portion 122 at positions corresponding to the through holes 15, 16 of the arm portions 11 of the connecting tube 10.

Figure 3:
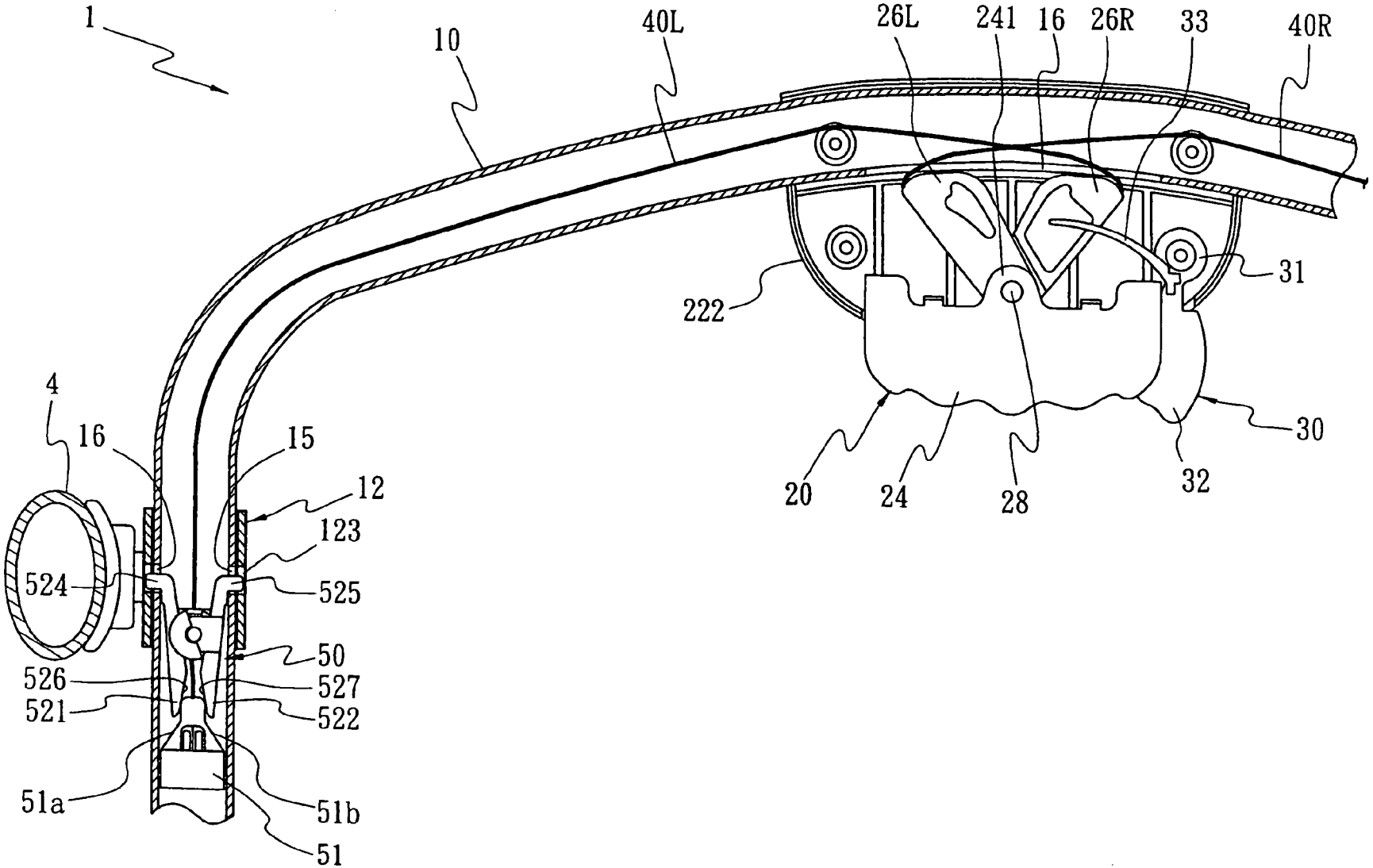
FIG. 3 is a partial cross-sectional top view of the collapsing device of the present invention illustrating the relationship among the components while the collapsing device is in a locked state.

FIG. 3 is a partial cross-sectional top view of the collapsing device 1 of the present invention. As shown in FIGS. 2 and 3, the collapsing device 1 mainly comprises an operating device 20, a safety button 30, two transmission cable (the left transmission cable 40L and right transmission cable 40R) and two engaging elements 50 (left engaging element and right engaging element).

Figure 4:
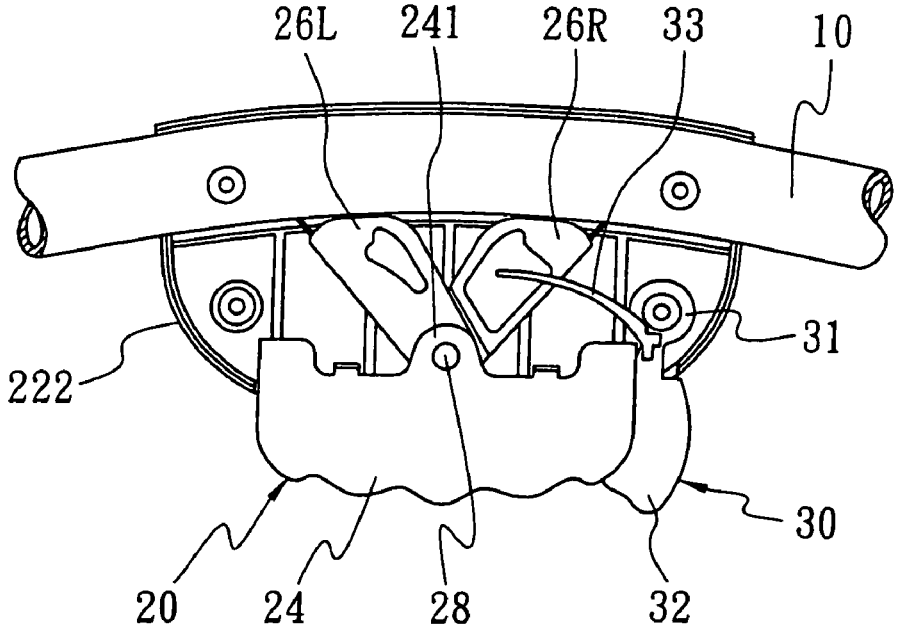
FIG. 4 is a top view of the operation button, the safety button, the actuating arms and the housing of the collapsing device of the present invention, wherein the upper part of the housing is removed for showing the structure inside the housing.
Figure 5:
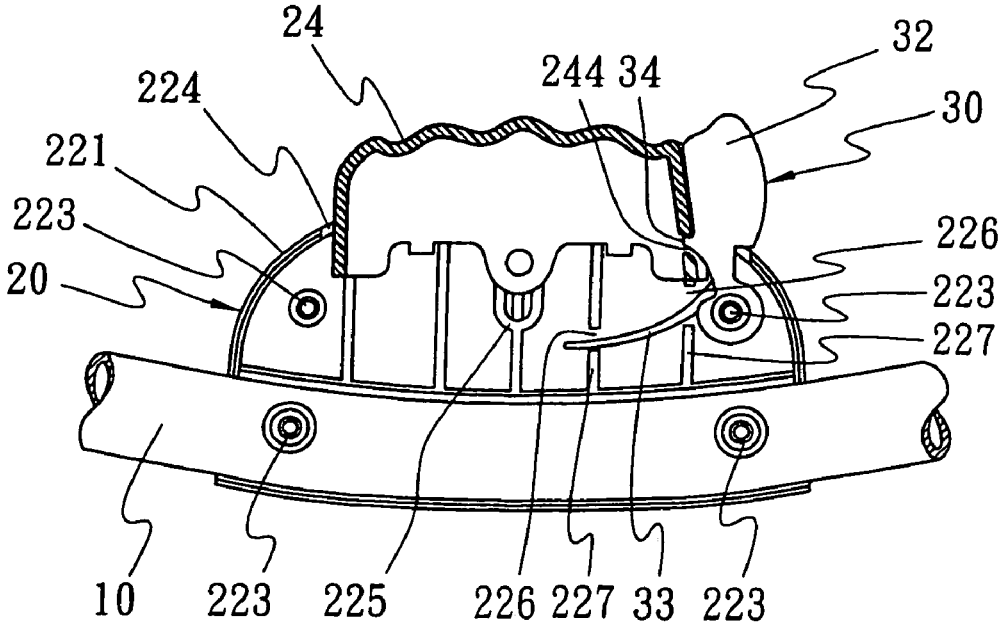
FIG. 5 is a partial cross-sectional bottom view of the housing with the bottom part of the housing and the actuating arms being removed.

Reference is now being made to FIGS. 3 and 4 to describe the structure of the operating device 20. The operating device 20 mainly comprises a housing 22, an operation button 24 and two actuating arms 26L, 26R. Referring further to FIG. 5, the housing 22 includes a first portion 221 and a second portion 222 which are assembled together and mounted to the transverse portion 13 of the connecting tube 10 by fixing members (such as screws 223 in FIG. 5). The first and second portions 221, 222 of the housing 22 both have a notch 224 (as shown in FIG. 5) formed at a sidewall away from the connecting tube 10 to form a receiving opening of the housing 22. In addition, first and second portions 221, 222 of the housing 22 each has a longitudinal groove 225 formed in a substantial central position of the surface facing each other. The first portion 221 further has a number of longitudinal ribs 227 formed on the surface facing the second portion 222 and at least one of the ribs 227 have a notch 226 formed therein (as shown in FIG. 5).

Figure 6:
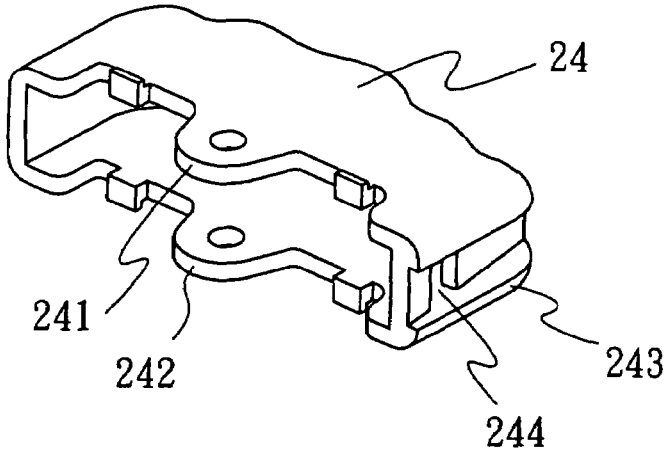
FIG. 6 is a perspective view of the operation button of the collapsing device of the present invention.

Referring further to FIG. 6 to describe the structure of the operation button 24. The operation button 24 is partially accommodated in the housing 22 through the receiving opening and has an upper ear portion 241 and a lower ear portion 242 formed at a central portion of a side that is received in the housing 22. In addition, there is a recess 243 formed in one lateral side of the operation button 24 and a hole 244 is formed in the bottom of the recess 243.

Figure 7:
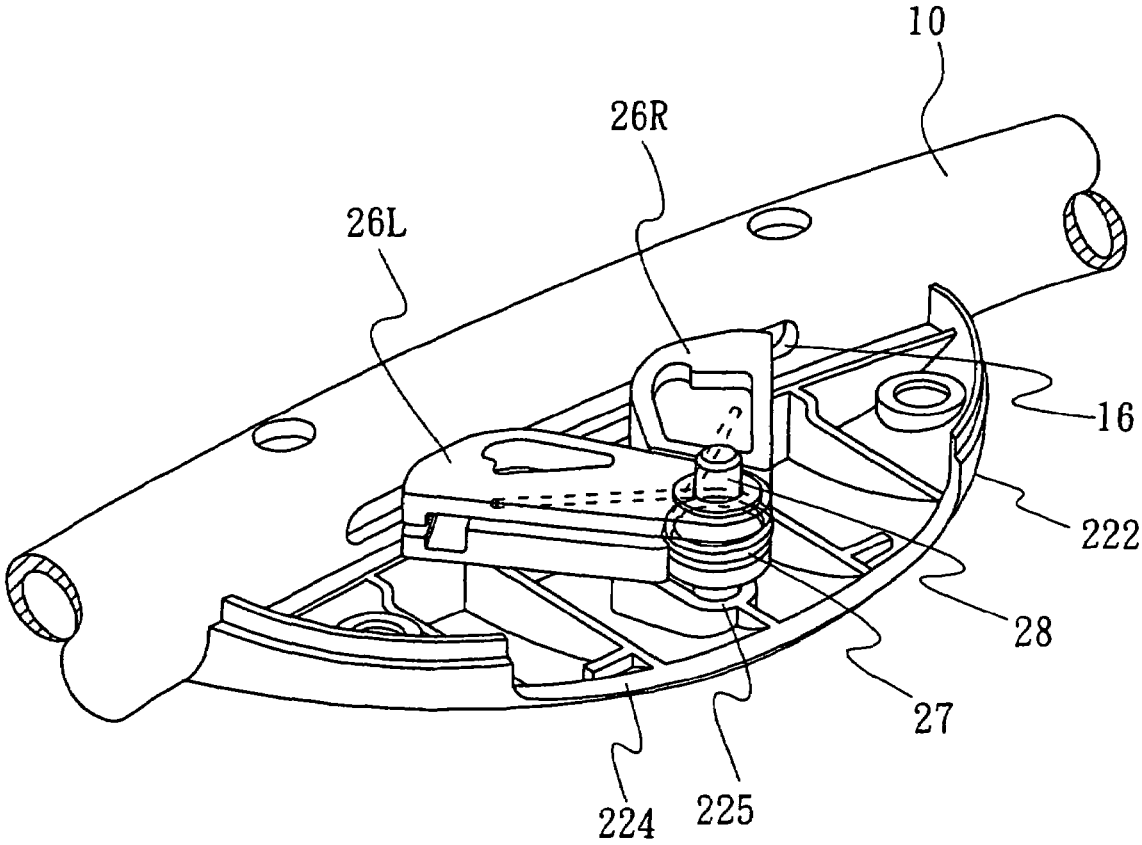
FIG. 7 is a perspective view of the actuating arms of the present invention, wherein the operation button is removed for showing the torsion spring disposed in the actuating arms.

Referring now to FIGS. 3 and 7 to describe the structure of the actuating arms 26L and 26R. As illustrated in the figures, the left and right actuating arms 26L, 26R are arranged in a V-shaped configuration with one end thereof being overlapped and disposed between the upper ear portion 241 and the lower ear portion 242. The left and right actuating arms 26L, 26R are pivotally coupled to the operation button 24 by inserting a pin 28 through the joint of the left and right actuating arms 26L, 26R and the upper and lower ear portions 241, 242. The ends of the pin 28 are disposed in the longitudinal grooves 225 formed in the first and second portions 221, 222 respectively so as to allow the operation button 24 to move relative to the housing 22 from a first position away from the transverse portion 13 of the connecting tube 10 and a second position close to the transverse portion 13 of the connecting tube 10. Furthermore, a torsion spring 27 is disposed between the ends of the left and right actuating arms 26L, 26R that overlap with each other. The torsion spring 27 has two limbs extending outwardly to form a substantially V-shaped configuration. The two limbs of the spring 27 are disposed in the left and right actuating arms 26L, 26R respectively so as to allow the left and right actuating arms 26L, 26R to pivot relative to each other resiliently. The left and right actuating arms 26L, 26R are arranged such that a free end thereof abutting the transverse portion 13 of the connecting tube 10 and the free end has an arcuate contour. The free ends of the left and right actuating arms 26L, 26R are connected with a transmission cable 40R, 40L respectively. The transmission cables 40R, 40L pass through an elongate opening 16 formed in the transverse portion 13 of the connecting tube 10 and extend in the connecting tube 10 so as to coupled to the engaging element 50 disposed in the arm portions 11 of the connecting tube 10. For instance, in the embodiment illustrated in FIG. 3, on one hand, the right transmission cable 40R that is connected to the free end of the left actuating arm 26L is coupled to the engaging element 50 disposed in the right arm portion of the connecting tube 10, and right actuating arm 26R on the other hand is coupled to the engaging element 50 disposed in the left arm portion of the connecting tube 10.

Now reference is made to FIGS. 4, 5 and 6 to describe the structure of the safety button 30. The safety button 30 includes a substantially ring-shaped installation portion 31, an operation portion 32, a resilient element 33 and a protrusion 34 formed at the same side with the resilient element 33. The safety button 30 is pivotally installed to the housing 22 by a fixing member (not shown) that is inserted through the installation portion 31, and is arranged such that one side of the operation portion 32 is adjacent to and received in the recess 243 of the operation button 24, thereby a protrusion 34 that is formed at one side of the operation portion 32 of the safety button 30 adjacent to the operation button 24 projects into the hole 244 formed in the recess 243. The resilient element 33 is an elongated member which laterally extends out from a position between the installation portion 31 and the operation portion 32 and abuts at least one of the longitudinal ribs 227 (see FIG. 5), so that a tail end of the resilient element 33 passes through the opening 116 of abuts a portion of the longitudinal rib 227.

Now referring to FIG. 8 to describe the structure of the engaging element 50. Since the structure of engaging elements 50 disposed in the right arm portion and the left arm portion of the connecting tube 10 is the same, only the structure of the engaging element 50 in the right arm portion of the connecting tube 10 is illustrated and described herein. The engaging element 50 mainly comprises an actuating member 51 and a locking member 52. In this embodiment, the structure of the locking member 52 is like a clothespin which includes two arm members 521, 522 pivotally coupled together at a substantially central portion thereof by a pivot (not shown) that is fixed to the connecting tube 10 and is arranged such that when one ends of the arm members 521, 522 is close to each other, the other ends thereof is away from each other. The locking member 52 further includes a spring 523 which is disposed between the arm members 521, 522 arranged to keep one end of the arm members 521, 522 close to each other and the other end away from each other. Additionally, a laterally outwardly projected protrusion 524, 525 is respectively formed at the other ends of the arm members 521, 522, a slanted surface 526, 527 is formed at a lateral side of the ends of the arm members 521, 522 that faces to each other. The actuating member 51 is a substantially cylindrical member with one end thereof being formed with a substantially triangle shaped portion having its two lateral sides being formed with a guide surface 51*a*, 51*b* respectively. The actuating member 51 is sized to be movable in the connecting tube 10 and disposed at a position adjacent to the ends of the arm members 521, 522 that are apart from each other to allow the guide surfaces 51*a*, 51*b* of the actuating member 51 in contact with slanted surface 526, 527 of the arm members 521, 522. Alternatively, the actuating member 51 may be a substantially cone-shaped member having a circumferential surface function as the guide surface. The transmission cable 40L passes between the arm members 521, 522 to connect to the actuating member 51. The entire engaging element 50 is disposed in the connecting tube 10 at a position adjacent to the through holes 15, 16 of the arm portion 11 of the connecting tube 10 so that the protrusions 524, 525 of the arm members 521, 522 may extend into the through holes 15, 16 respectively to thereby locking the connecting tube 10 in position.

Figure 9:
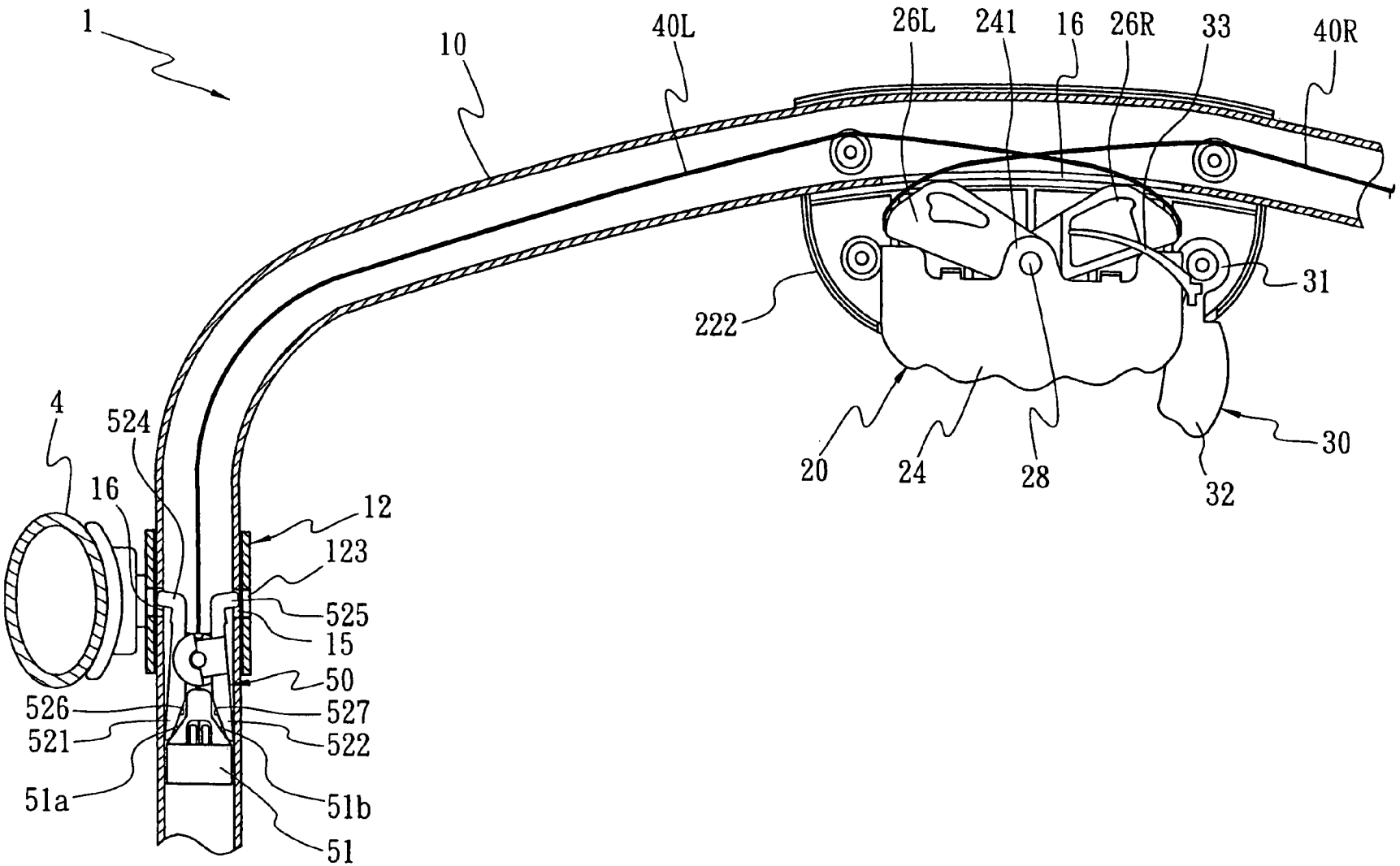
FIG. 9 is a partial cross-sectional top view illustrating the relationship among the components while the collapsing device of the present invention is activated into an unlocked state.

Now, the operation of the collapsing device 1 of the present invention will be described in conjunction with FIGS. 3 and 9.

When the operation button 24 of the operating device 20 is in its un-operated state (i.e., the first position illustrated in FIG. 3), the safety button 30 is at a locked position abutting the operation button 24 so as to allow the protrusion 34 of the safety button 30 to extend into the hole 244 of the operation button 24 (see FIG. 5) to prevent the operation button 24 from being pressed toward the transverse portion 13 of the connecting tube 10 to achieve the safety function of preventing the operation button 24 being accidentally operated. In this state, the two protrusions 524, 525 of the locking member 52 of the engaging element 50 extend through the holes 15, 16 of the connecting tube 10 and into the engaging holes 123 of the supporting portion 122 of the mounting seat 12 (this is a locked state of the engaging element 50), so that the connecting tube 10 is unable to slide relative to the mounting seat 12 and the child seat is thus locked in the extended state illustrated in FIG. 1A.

When the child seat needs to be collapsed, a user first pushes the safety button 30 in a direction away from the operation button 24 to an unlocked position to allow to allow the protrusion 34 of the safety button 30 to be retreated from the hole 244 of the operation button 24 (at this time, the resilient element 33 of the safety button 30 is resiliently deformed because it is hindered from pivoting by the longitudinal rib 227 of the first portion 221 of the housing 22). Then, the user may press the operation button 24 in a direction toward the transverse portion 13 of the connecting tube 10 to a second position to move the left and right actuating arms 26L, 26R closer to the transverse portion 13 of the connecting tube 10. During this process, the left and right actuating arms 26L, 26R will pivot away from each other to a tensioned position because of the arcuate feature of their free ends to pull the right and left transmission cables 40R, 40L connected thereto and cause the actuating members 51 of the engaging element 50 that are connected to the other end of the cables 40R, 40L to move toward the locking members 52 (only the left actuating member 51 and the left locking member 52 are illustrated in the figures). In the meantime, because the inclined guide surfaces 51*a*, 51*b* of the actuating member 51 move along the slanted surfaces 526, 527 of the arm members 521, 522, the end of the arm members 521, 522 that is respectively formed with slanted surface 526, 527 is pushed away from each other to cause the ends of the arm members 521, 522 that are formed with a protrusion 524, 525 (only the protrusion 524 is shown) to move close to each other to thereby causing the protrusions 524, 525 to retreat out from the engaging holes 123 of the supporting portion 122 of the mounting seat 12 (i.e., in an unlocked state) and thus allowing the connecting tube 10 to slide relative to the mounting set 12. In this state, the user may lift the connecting tube 10 with the operation button 24 being pressed to cause the front legs 3, 3 to pivot toward the rear legs 4, 4 and thus fold the child seat into a collapsed state as illustrated in FIG. 1B.

After the child seat is in the desired collapsed state, the operation button 24 may release and the actuating arms 26L, 26R are pivoted toward each other back to their loosened position under the action of the torsion spring 27 to loosen the tensioned transmission cables 40 to allow the actuating member 51 of the engaging element 50 to be pushed away from the arm members 521, 522 of the locking member 52 under the action of the spring 523. While the actuating arms 26L, 26R being pivoted toward each other, the operation button 24 is pushed in a direction away from the transverse portion 13 of the connecting tube 10 back to its first position and the operation portion 32 of the safety button 30 is pivoted from its unlocked position toward the operation button 24 to its locked position under the action of the resiliently deformed resilient element 33 of the safety button 30 and allow the protrusion 34 of the safety button 30 to once again project into the hole 244 of the operation button 24.

When the collapsed child seat needs to be extended for use, the connecting tube 10 may be pushed downward and backward-directly without operating the safety button 30 and operation button 24 to cause the front legs 3, 3 to be pivoted away from the rear legs 4, 4. At this time, the connecting tube 10 may pivot relative to the rear legs 4, 4 and slide relative to the mounting seat 12 until the connecting tube 10 slides to the position that the through holes 15, 16 of the connecting tube 10 align with the engaging holes 123 of the supporting portion 122 of the mounting seat 12, the protrusions 524, 525 of the arm members 521, 522 once again project into the engaging holes 123 to lock the connecting tube 10 relative to the mounting seat 12 to thereby lock the child seat in an extended state as illustrated in FIG. 1A.

Although the collapsing device with safety designs of the present invention has been described in the preceding paragraphs by using its application in the child seat as an example for describing. It does not imply that the collapsing device of the present invention can only be used in the child seat. On the contrarily, people skilled in this art may find other applications for the collapsing device of the present invention, for instance, the collapsing device of the present invention may be applied in a stroller. Moreover, It will be apparent to people skilled in this art that many modifications can be made to the disclosed structures without departing from the scope of the invention. Therefore, it is the intent of the appended claims to cover all such variations and modifications as come within the sprit and scope of this invention.

What is claimed is:

1. A collapsing device for a child seat, the child seat having a stand which includes a connecting tube which has two arm portions connecting to the stand, the collapsing device for a child seat comprising:

an operating device configured for mounting to the connecting tube and having an operation button and an actuating unit coupled to the operation button, the actuating unit being operable by the operation button to move from a first position to a second position;

at least one engaging element configured to be operably disposed in the arm portion of the connecting tube and including a locking member, the locking member being movable between a locked position at which the locking member engages with the stand and the connecting tube and an unlocked position at which the locking member disengages from the stand; and at least one transmission member having two ends, a first end being connected to the actuating unit of the operating device and a second end being connected to the at least one engaging element, whereby the locking member is moved from the locked position to the unlocked position by the operation button through the at least one transmission member, so that the child seat can be collapsed from an extended state to a collapsed state, wherein the locking member comprises two pivotally coupled arm members and a clip spring disposed between the arm members, the two arm members and the clip spring being arranged such that while first ends of the two arm members are close to each other, opposite second ends of the two arm members are apart from each other, each of the arm members having a laterally projected protrusion formed at the second end thereof.

2. A collapsing device according to claim 1, further comprising a safety member which is pivotally coupled to the operation button and is arranged selectively to prevent the operation button from being operated.

3. A collapsing device according to claim 1, wherein the at least one engaging element further comprises an actuating member which is connected to the at least one transmission member to actuate the locking member to move from the locked position to the unlocked position.

4. A collapsing device according to claim 3, wherein the at least one transmission member passes through the locking member and connects the actuating unit and the actuating member at two ends.

5. A collapsing device according to claim 3, wherein a slanted surface is formed at the first ends of each of the arm members such that the slanted surfaces face each other, and guiding surfaces are formed on the actuating members at positions corresponding to the slanted surfaces.

6. A collapsing device according to claim 3, wherein the actuating member comprises a hollow cone-shaped member.

7. A collapsing device according to claim 3, wherein the actuating member is sized and shaped to be slidable in the connecting tube and separates from the locking member.

8. A collapsing device according to claim 1, wherein the stand further comprises front legs and rear legs pivotally connected to the front legs, wherein a free end of the respective arm portion of the connecting tube is pivotally coupled to the front legs and the rear legs each having a mounting seat for the locking member to engage and disengage therewith.

9. A collapsing device according to claim 8, wherein the mounting seat includes a mounting portion and a supporting portion, wherein the supporting portion is rotatably coupled to the mounting portion and slidably receives the arm portion of the connecting tube, so as to allow the connecting tube to pivot relative to the stand.

10. A collapsing device for a child seat, the child seat has a stand which includes a connecting tube and legs wherein the connecting tube has two arm portions connecting to the legs, the collapsing device for a child seat comprises:

an operating device which includes a housing configured for mounting to the connecting tube, an operation button which is operably connected to and partially accommodated in the housing and is arranged such that it is capable of moving relative to the housing between a first position away from the connecting tube and a second position close to the connecting tube, and a pair of actuating arms, a respective first end of the actuating arms being pivotally coupled to the operation button and a respective second end having an arcuate contour and being disposed adjacent to the connecting tube, such that the operation button is moved between the first position away from the connecting tube where the second ends of the actuating arms are resiliently pivoted close to each other and the second position close to the connecting tube where the second ends of the actuating arms are apart from each other;

two engaging elements each configured to be operably disposed in the arm portion of the connecting tube and including a locking member for retaining the engaging element in position, the locking member being movable between a locked position at which the locking member engages with the stand and the connecting tube and an unlocked position at which the locking member disengages from the stand and the connecting tube; and two transmission members each having two ends which are connected to one of the actuating arms of the operating device and one of the two engaging elements respectively, wherein the locking member is moved from the locked position to the unlocked position by the operation button through one of the two engaging elements, so that the child seat can be collapsed from an extended state to a collapsed state.

11. A collapsing device according to claim 10, wherein the stand further comprises front legs and rear legs pivotally connected to the front legs, and wherein a free end of each respective arm portion of the connecting tube is pivotally coupled to the front legs and the rear legs, each rear leg being provided with a mounting seat to engage with/disengage from the locking member.

12. A collapsing device according to claim 10, wherein the two actuating arms are arranged in a form of a substantially V-shaped arrangement, and a torsion spring is disposed at a joint of the V-shaped actuating arms and has two limbs disposed in the actuating arms respectively, so as to allow the actuating arms to pivot resiliently with each other.

13. A collapsing device according to claim 12, further comprising a safety member which is pivotally coupled to the operation button and is arranged such that an unintentional operation of the operation button may be prevented.

14. A collapsing device according to claim 10, wherein the locking member comprises two pivotally coupled arm members and a clip spring disposed between the arm members, wherein the two arm members and the clip spring are arranged such that while a first end of each of the two arm members are close to each other, opposite second ends thereof are apart from each other, and each of the arm members has a laterally projected protrusion formed at the second end thereof.

15. A collapsing device according to claim 14, wherein the two engaging elements further comprise an actuating member which is connected to the transmission member to actuate the locking member from the locked position to the unlocked position.

16. A collapsing device according to claim 15, wherein the actuating member comprises a hollow cone-shaped member.

17. A collapsing device according to claim 15, wherein the actuating member is sized and shaped to be slidable in the connecting tube and separates from the locking member.

18. A collapsing device according to claim 15, wherein a slanted surface is formed at the first ends of each of the two arm members such that the slanted surfaces face each other, and guiding surfaces are formed on the actuating member at positions corresponding to the slanted surfaces.

19. A collapsible child seat convertible between an extended state and a collapsed state, comprising:

a stand having two front legs, two rear legs pivotally connected to the front legs, and a substantially U-shaped connecting tube having a pair of arm portions and a transverse portion connecting to the arm portions at each end thereof, a first end of each arm portion being pivotally coupled to the front leg and a second end thereof being slidably coupled to a mounting seat of the rear leg, a collapsing device provided on the connecting tube and having a pair of engaging devices disposed in the pair of arm portions respectively;

wherein the collapsing device is operable between a locked state where the engaging devices are engaged with the mounting seat of each of the rear legs, and an unlocked state where the engaging devices are disengaged from the mounting seat of each of the rear legs, and the arm portions of the connecting tube are capable of sliding relative to the mounting seats and pivoting relative to the front legs and the rear legs to allow the child seat to be converted from the extended state to the collapsed state, and wherein the collapsing device includes an operating device mounted on the transverse portion of the connecting tube for selectively moving the engaging devices.

20. A collapsible child seat according to claim 19, wherein the mounting seat includes a mounting portion and a supporting portion, wherein the supporting portion is rotatably coupled to the mounting portion and slidably coupled to the arm portion of the connecting tube, so as to allow the connecting tube to pivot relative to the stand.

* * * * *